US006349692B1

(12) United States Patent
Reinosa

(10) Patent No.: US 6,349,692 B1
(45) **Date of Patent: *Feb. 26, 2002**

(54) METHOD AND APPARATUS FOR REDUCING WEAR IN AN INTERNAL COMBUSTION ENGINE

(76) Inventor: Adan Reinosa, 1729 Westmoreland Dr., Montebello, CA (US) 90640

( * ) Notice: Subject to any disclaimer, the term of this patent is extended or adjusted under 35 U.S.C. 154(b) by 0 days.

This patent is subject to a terminal disclaimer.

(21) Appl. No.: 08/924,381

(22) Filed: Sep. 5, 1997

Related U.S. Application Data

(63) Continuation-in-part of application No. 08/807,022, filed on Feb. 26, 1997, now Pat. No. 5,743,231, and a continuation-in-part of application No. 08/821,998, filed on Mar. 22, 1997, now Pat. No. 5,782,315.

(51) Int. Cl.[7] ..... F01M 5/02
(52) U.S. Cl. ..... 123/196 S; 184/6.4
(58) Field of Search ..... 123/196 S, 196 A; 184/6.4

(56) References Cited

U.S. PATENT DOCUMENTS

| | | | |
|---|---|---|---|
| 4,094,293 A | 6/1978 | Evans | 123/196 S |
| 4,199,950 A | 4/1980 | Hakanson et al. | 123/196 CP |
| 4,359,140 A | 11/1982 | Shreve | 184/6.3 |
| 4,502,431 A | 3/1985 | Lulich | 123/179.1 |
| 4,524,734 A | 6/1985 | Miller | 123/196 S |
| 4,703,727 A | 11/1987 | Cannon | 123/196 S |
| 4,825,826 A | 5/1989 | Andres | 123/196 S |
| 4,834,039 A | 5/1989 | Apostolides | 123/196 S |
| 4,936,272 A | 6/1990 | Whitmore | 123/196 S |
| 4,940,114 A | 7/1990 | Albrecht | 184/6.3 |
| 5,000,143 A | 3/1991 | Brown | 123/196 S |
| 5,156,120 A | 10/1992 | Kent | 123/196 S |
| 5,195,476 A | 3/1993 | Schwarz | 123/196 S |
| 5,197,424 A | 3/1993 | Blum | 123/196 S |
| 5,236,064 A | 8/1993 | Wagoner | 123/196 S |
| 5,372,219 A | 12/1994 | Peralta | 123/196 S |
| 5,488,935 A | 2/1996 | Berry, Jr. | 123/196 S |
| 5,511,522 A | 4/1996 | Tran | 123/196 S |
| 5,743,231 A | 4/1998 | Reinosa | 123/196 S |
| 5,782,315 A | 7/1998 | Reinosa | 184/6.3 |

*Primary Examiner*—John Kwon
(74) *Attorney, Agent, or Firm*—Frank M. Weyer

(57) ABSTRACT

An apparatus for reducing wear in an internal combustion engine includes a pump, a control element, an external controller. The apparatus of the preferred embodiment is intended to be located inside an internal combustion engine, thereby eliminating most hardware. The control element is connected to a normally provided battery and automatically switches control power from the battery to the electric pump according to a programmed control operating cycle program, and is operatively independent of ignition switch activation or operator action. The inlet of the pump is immersed in oil inside the normally provided engine oil sump. The lubricating fluid is pumped through the high arrestance filter, yielding a substantially contaminant free lubricating fluid which flows into the normally provided engine lubricating gallery. The external controller, such as a wireless remote control, is provided to activate the pump remotely upon demand. In a second embodiment, a three-way valve is provided to facilitate evacuation of the oil sump for the purpose of an oil change by overriding automatic operation of the electric pump by a local control switch. In the second embodiment the inlet of the electric pump is dimensioned to be affixed and fluidly connected to the oil sump. An assembly adapter is disclosed that facilitates installation of the present invention, allows for easy fluid access to the engine oil gallery, and prevents backflow of the periodically injected oil which is done acording to the present invention operating strategy. The method discloses the periodic injection of oil into the lubricating galleries, whereby by continuously repeating the operating cycle the engine is automatically protected from wear by simultaneous priming, purifying and prelubricating.

20 Claims, 7 Drawing Sheets

METHOD AND APPARATUS FOR REDUCING WEAR IN AN INTERNAL COMBUSTION ENGINE

RELATED APPLICATIONS

The present application is a continuation-in-part of commonly owned U.S. patent application Ser. No. 08/807,022, U.S. Pat. No. 5,743,231 filed Feb. 26, 1997 and U.S. patent application Ser. No. 08/821,998, U.S. Pat. No. 5,782,315 filed Mar. 22, 1997.

BACKGROUND-FIELD OF THE INVENTION

The present invention relates to internal combustion engines, and more particularly to improvements, to a method and apparatus for admitting a lubricating fluid into the existing lubrication system of those engines for prelubricating the engine before start-up to reduce wear on the moving parts of the engine.

BACKGROUND-DESCRIPTION OF THE PRIOR ART

Internal combustion engines depend for their proper lubrication to be already running. During start-up, proper lubrication is not immediately achieved since all the oil or lubricant in the normally provided engine oil galleries is evacuated by gravity action. After the elapsing of a period of time, the oil adhered to the slidable working surfaces, engine lubricating galleries, and parts, drains to the bottom reservoir or oil sump. This leaves the slidable working surfaces unprotected from wear during the next start-up. McDonnell Douglas has performed tests which indicate that up to 90 percent of the wear in an internal combustion engine occurs during such start-ups or dry-starts due to oil starvation. Other wear mechanisms account for substantial wear in engines. These wear mechanisms are attributed mainly to suspended solid particles and chemical contaminants in the lubricating oil.

Most prior art systems addressing this problem rely on activation immediately prior to and/or during starting of the internal combustion engine. These methods introduce inconveniences such as waiting for the operating cycle to occur, required operator action, and difficult installation. Such inconvenient time delay is irritating to the vehicle operator and in some prior art may even be dangerous should the vehicle stall and needs to re-start immediately. There still is the long-felt need to have a system that delivers the desired benefits automatically, without waiting, and easily installed. In addition, prior art does little to address the added benefits of removing solid and chemical contaminants from the lubricating oil in combination with their prelubricating functions, and the benefits of substantially reducing the time required to reach normal oil pressure immediately after start-up as a result of the present invention automatic priming. Such contamination contributes substantially to engine wear and physical degradation of the engine lubricating oil. Normally provided filters in automobiles remove suspended solid particles larger than approximately 25 microns. Introduction of a filter rated for much higher arrestance for suspended solids with the additional function of separating chemicals from the oil and cooperating with the present invention solves and additional wear problem not addressed in prior art.

Prior art devices are required to be larger and more complicated installations because they need to overcome the specification of quick on demand delivery of lubricating oil.

The present invention suggests and discloses a method and apparatus with an automatic system which substantially delivers the expected benefits, with the unexpected result of no waiting time and inherent reduction in size and cost. Further, it addresses additional wear mechanisms by simultaneous removal of solid and chemical contaminants from the lubricating oil.

Some prior art depend for their performance on a compressed chamber of potentially flammable liquid inside a hot engine bay. Rupture of the holding chamber inside a hot engine bay will produce a fire and environmental hazard. For example, a preoiling system depicted in U.S. Pat. No. 2,736,307, which issued to Wilcox on February 1956, includes a high pressure pump for charging a reservoir with engine oil which is released by engagement of the starter switch. Another type of lubricating system, depicted in U.S. Pat. Nos. 2,755,787 and 3,422,807, releases oil from a reservoir as the ignition is activated. A preoiler with a solenoid valve is shown in U.S. Pat. No. 3,556,070 and U.S. Pat. No. 3,583,525. A valve arrangement, depicted in U.S. Pat. No. 3,583,527, which issued to Raichel on June 1971, controls the charge and discharge of a reservoir of oil under pressure in response to the closing of the ignition switch. Another engine preoiler, disclosed in U.S. Pat. No. 4,061,204, includes a valve arrangement in the base of an accumulator having multiple ports. U.S. Pat. No. 4,094,293 depicts an engine pre-oiler with a pressurized reservoir for containing engine oil. Yet another prelubrication device depicted in U.S. Pat. No. 4,112,910, shows a holding mechanism for a coiled power spring which is released on actuation of the ignition system whereupon oil in a chamber is evacuated. U.S. Pat. No. 4,359,140, which issued to J. Shreve on November 16, 1982, discloses an auxiliary engine oiler including a reservoir for storing a lubricant under pressure. Another approach is U.S. Pat. No. 5,156,120, which issued to Kent on October 20, 1992, discloses a system with an accumulator for holding lubricant under pressure and returning the lubricant upon engine start-up. Yet another prelubrication system, depicted in U.S. Pat. No. 4,703,727, which issued to Cannon on November 1987, shows a high pressure oil pump, controlled by an ignition switch and an oil pressure sensor, for supplying oil to an engine immediately prior to start-up. These systems introduce inconvenience, safety and potential environmental problems.

Another approach is to provide a prelubrication system such as those disclosed in U.S. Pat. Nos. 3,066,664, which issued to McNew et al. on December 1962; 3,722,623, Waldecker; 3,842,937, Lippay et al.; 4,157,744, Capriotti; 4,168,693, Harrison; 4,524,734, Miller; 4,502,431, Lulich; 4,834,039, Apostolides; 4,825,826, Andres; 4,875,551, Lulich; 4,893,598, Stasiuk; 4,936,272, Whitmore; 4,940,114, Albrecht; and 5,000,143, which issued to Brown on March 1991. Generally, these patents disclose supplementary oil pumping systems which inject oil into the engine immediately prior to cranking and/or start-up. Although these references partially address the problem of prelubricating the engine, there are many undesirable design drawbacks and unrecognized problems to such systems. Additional elements in prior art increase the complexity and costs of installation and maintenance of such systems, as well as the space requirements in an already cramped engine bay. Some have required original fabrication of at least some of its components. Consequently, the size, complexity, cost and problems associated with the installation and maintenance of such systems has prevented their widespread use in most vehicles. It is estimated that less than approximately 1 in 10,000 automobiles have an engine prelubrication system.

Another approach is U.S. Pat. No. 4,199,950, which issued to A. Hakanson et al. on Apr. 29, 1980, which discloses a system for prelubricating an engine during starting in the form of an atomized mist generated by a nozzle operating under high pressure conditions. U.S. Pat. No. 4,502,431, which issued to J. Lulich on Mar. 5, 1985, discloses an oil pumping system driven from the starter motor which generates oil pressure prior to start-up.

Another approach is U.S. Pat. No. 5,195,476, which issued to Schwarz on Mar. 23, 1993, discloses a system for prelubricating an engine by using the pump provided by the manufacturer as a means to pressurize the oil immediately before start-up, but at the expense of introducing undesirable wear and tear on the starting and electrical system, and inconvenience. U.S. Pat. 5,121,720, which issued to Roberts on June 1992, discloses a prelubrication system that operates upon the operator opening the door, with the problem of inconvenience, and unnecessary wear and tear of the apparatus due to false open door signals.

Yet another approach is found in U.S. Pat. No. 5,488,935 issued to R. L. Berry Jr. on Feb. 6, 1996, which discloses a single charge pressurized oil injection system comprising a pressure accumulator and a normally closed electromagnetic valve operated when the ignition switch is turned to the on position. Other relatively unsafe hydraulic accumulators have been provided in prior art which could be applied in the field of invention. For example, U.S. Pat. No. 2,300,722 to Adams et al. which issued on Nov. 1942; U.S. Pat. No. 2,394,401 to Overbeke; U.S. Pat. No. 2,397,796 to Lippincott; U.S. Pat. No. 4,769,989 to Oswald et al.; U.S. Pat. No. 5,197,787 to Matsuda et al.; and U.S. Pat. No. 5,494,013 to Helbig, which issued on February 1996, are illustrative of such prior art.

One recent approach to this problem is to introduce into the engine oil chemical additives which cling to the walls of the cylinders and other movable parts after the engine is shut off. These additives have questionable effectiveness and permanency, since their effectiveness is extremely difficult, if not impossible, to ascertain or verify. In addition, booster doses are needed periodically due to degradation and oil changes. However, the present invention cooperates and enhances whatever possible benefits of this approach by automatically and periodically delivering the treated oil to the required working surfaces.

Each of the noted patents deals with the dry-start problem in either an incomplete or ineffective manner, unsafe, potentially dangerous by way of holding pressurized combustible material inside a hot engine bay; or by way of complex, energy intensive, and costly apparatus due to real time on demand immediately prior to start-up requirements. Therefore, most prior art prelubrication systems supply oil to the engine parts, immediately prior to ignition and while the operator waits for the cycle to occur, introducing various undesirable and costly design trade-offs, and high levels of inconvenience to the user operator. More specifically, the mutually exclusive design requirements of reducing the cycle time prior to start-up at the expense of increased pump size, energy demands, and volumetric capacity. In other words, a pump or reservoir under pressure is unable to deliver the desired prelubricating functions instantaneously or in zero time. Therefore, the foregoing prior art references operating strategies are inherently inconvenient, or in the case of chemicals, hard to verify their effectiveness.

Accordingly, there has continued to be a need for a prelubricating system which is effective, simple, inexpensive to manufacture and operate, which is easy to install in an existing engine without major modifications to the engine assembly. A system which automatically and simultaneously cooperates in adding to its prelubricating functions the functions of engine lubricating gallery priming and removal of contaminants from the lubricating oil to further enhance the system wear reduction capabilities by addressing additional wear mechanisms. A system which enjoys favorable design trade-offs due to its method of operation, and more specifically benefits related to substantial reduction of size and hardware, and increased convenience. A system which is easily adapted to automobile production lines as an internal part of the engine due to its inherent size. A system which is safe to operate in a confined high temperature engine bay, and that delivers wear reduction and oil purification results automatically. A system that delivers the desired results automatically, by including unsuggested modifications in prior art. And more specifically, a system which performs its programmed operation without having the user wait a single moment immediately prior and independent of engine start-up or ignition switch, resulting in a system which delivers the highest possible convenience to its user operator.

SUMMARY OF THE INVENTION

The present invention solves the problems encountered in prior art arrangements with a lubricating system which is automatic, independent of startup time or occurrence, convenient and largely ignored by the engine operator. The system includes a pressure raising device having its inlet connected to a suitable point where a lubricating fluid is located, or immersed in the fluid to be pumped, or inside the engine to be protected. The lubricating oil is then pressurized by a pressure raising fluid delivery device or pump into the normally provided lubricating gallery of an internal combustion engine. Since the problem of dry startup is caused by the absence of oil after a suitable amount of time due to gravity action, the pressure device or pump is operated by an electronic controller, which controls the pressure raising device or pump to deliver an amount of lubricating oil to the lubricating galleries of the engine. Therefore, this keeps internal moving parts impregnated and substantially protected with lubricating oil to substantially reduced wear during the following or next startup cycle, and the engine galleries substantially primed with oil to greatly reduced the time to reach normal operating oil pressure upon startup. This operating cycle time is smaller than the time required for gravity to fully evacuate the lubricating galleries and internal moving metallic surfaces.

The mechanisms of wear in an engine are caused by the absence of oil from wear intensive surfaces during start-up, the time required to achieve normal operating pressure immediately after start-up, abrasion during engine operation caused by solid contaminants suspended in the lubricating oil, and chemical contaminants in the lubricating oil which attack metallic surfaces and degrades the protecting lubricating properties of the lubricating oil. The pump of the present invention is actuated for a predetermined duration by a solid state timing control device, solid state controller, programmable digital logic controller, adaptive controller, or electronic controller which automatically switches control power from the normally provided battery to the pump according to an operating cycle. The pump removes contaminated oil from the oil sump and delivers substantially purified lubricating fluid to the lubricating galleries in the engine. After the elapsing of a predetermined period of time, the cycle is repeated automatically. Therefore, this periodic action keeps internal moving parts substantially prelubricated at all times with purified lubricating oil prior to the next start-up cycle, keeps the engine galleries substantially primed or filled up to reduce the time required to reach normal oil pressure, flushes galleries of residual oil coking from post-shutdown residual heat, and removes solid particles suspended in the lubricating oil, and removes the chemical contaminants from the lubricating oil.

OBJECTS AND ADVANTAGES

Accordingly, there exists a need for an engine wear reduction system which will reduce engine wear and will be simpler, less expensive, more space efficient, and more easily installed and maintained in existing and as an easily installed engine part in an automobile assembly line than prior art prelubricating systems.

It is therefore, a primary object of the present invention to provide an engine wear reduction system that, is automatic and independent of engine start-up or ignition switch activation, which includes unappreciated advantages and unsuggested modifications in prior art, that has all the advantages and the additional complementary wear prevention benefits from the function of priming, and has none of the unrecognized problems and undesirable design shortcomings found in prior art.

An additional object of the present invention is to provide an engine wear reduction system, that includes previously unsuggested modifications which automatically and simultaneously removes contaminants and suspended wear causing particles from the lubricating oil, that automatically primes the internal engine lubricating galleries with substantially purified lubricating oil, and that automatically prelubricates the engine wear surfaces with substantially purified lubricating oil.

A further object of the present invention is to provide an engine wear reduction system, that is automatic and does not require ignition switch activation or engine operator action immediately before start-up for its operation, in order to overcome the unrecognized problem of waiting and unsafe operation in prior art.

An additional object of the present invention is to provide an engine wear reduction system, that includes a commercially available solid state timing control device, programmable controller, or adaptive control element which stores or adapts an optimized pre-programmed operating strategy to maximize convenience, wear prevention functions, and to minimize system activation to increase the longevity of the system.

Yet another object of the present invention is to provide an engine wear reduction system, that is compact, modularly designed and manufactured from commercially available components, as a result of favorable design trade-offs, having as a result a compact modular timed pump unit.

A further object of the present invention is to provide an engine wear reduction system, that solves the unrecognized problems of installation and unfavorable design shortcomings related to single function, inherent larger size, larger energy demands, oil volume variations, and added hardware of prior art devices.

A still further object of the present invention is to provide an engine wear reduction system, that has favorable design trade-offs and synergies, and the unrecognized advantage of a low cost of manufacture with regard to both material and labor, and which accordingly has the advantage of low price of both sale and installation to the consuming public, thereby making such engine wear reduction system economically available to the buying public.

Yet another object of the present invention is to provide an engine wear reduction system, that is safer and more environmentally responsible when compared to prior art which utilizes a pressurized oil accumulator in combination with an ignition switch controlled electromagnetic valve immediately prior to start-up.

A further object of the present invention is to provide an engine wear reduction system, that is a more easily installed engine part in an automobile assembly line due to the unexpected results of its operating strategy and the resulting previously unappreciated advantage of its inherently smaller number of parts, readily accessible connection points, and physical size than prior art prelubrication systems.

Another object of the present invention is to provide an engine wear reduction system, that requires for electrical connection only one pair of wire means, which does not require connection to the ignition switch or other dash installed switch, and that leads to a more easily installed and safer device.

Yet another object of the present invention is to provide an engine wear reduction system, that is a more compact and easily installed accessory in current and older motor vehicles due to its inherently smaller number of parts, number of easily accessible connection points, and physical size than prior art prelubrication systems.

A still further object of the present invention is to provide an engine wear reduction system, that automatically primes and flushes oil residues from post shut-down residual heat oil coking from the walls of the internal lubricating galleries of said engine with substantially purified lubricating oil to reduce wear by substantially reducing the time required by the engine to reach normal pressure immediately after start-up due to priming and keep them clog-free over the long-term due to flushing.

Yet another object of the present invention is to provide an engine wear reduction system, that is easily available to the buying public and through its adoption on a large scale will contribute to the enhancement of the environment by making engines run more efficiently, avoiding waste of national resources, and deferring the use of natural resources.

Further objects of the invention will appear as the description proceeds and claims drawn. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

The present invention will be more fully understood by reference to the following detailed description thereof when read in conjunction with the attached drawings, in which like reference characters designate the same or similar parts throughout the several views, wherein.

REFERENCE NUMERALS IN DRAWING

Figure 1:
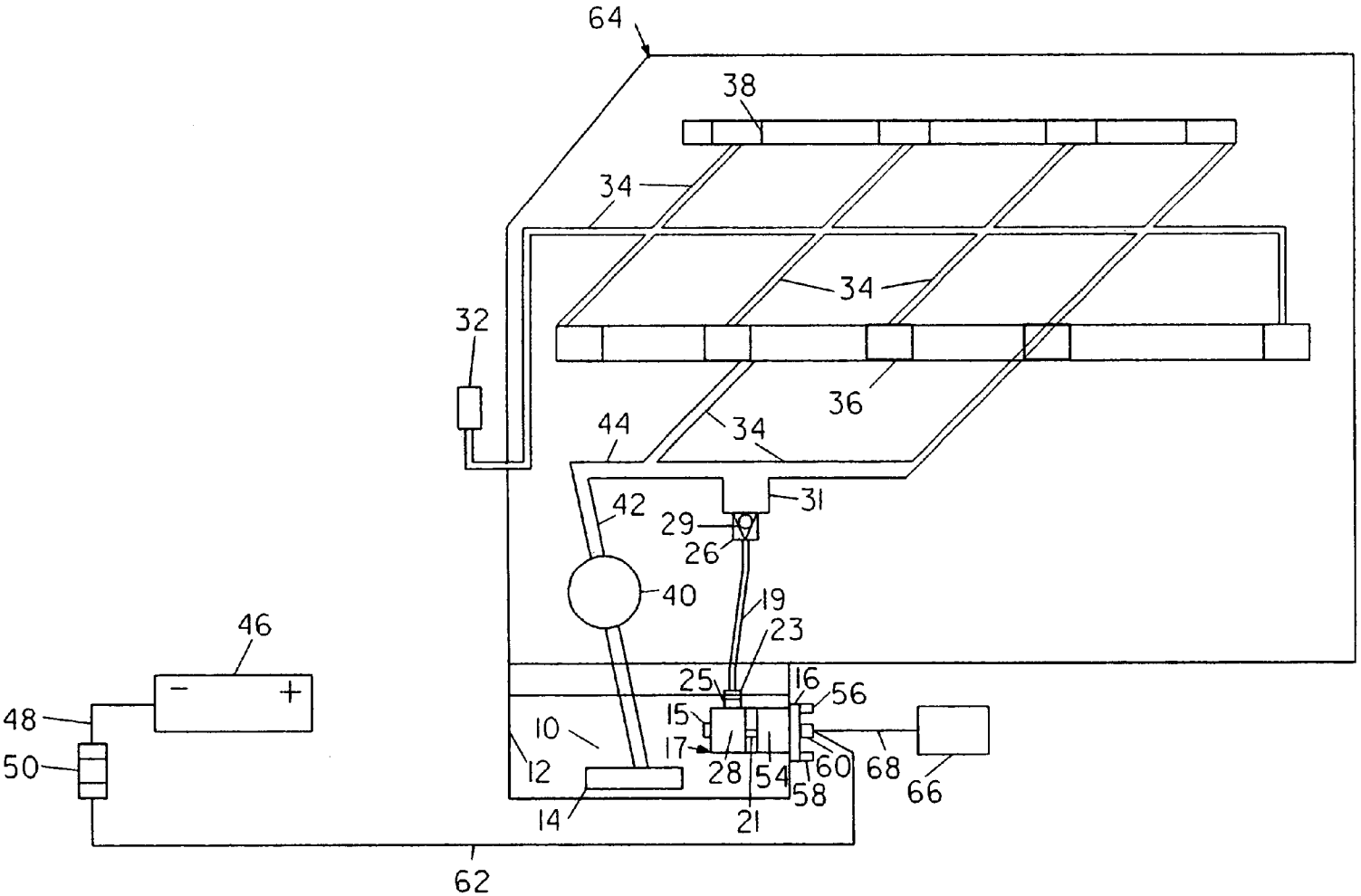
FIG. 1 is a detail side view illustrating the components of the engine wear reduction system according to a first embodiment of the present invention installed inside the oil pan of a conventional engine and internally connected to the oil gallery of a typical engine block.

10. Lubricating oil
12. Oil sump
14. Engine oil pump pick-up
15. Hydraulic pump inlet
16. Oil sump adapter and installation fixture
17. Timed pump
18. Modified drain plug
19. Hydraulic line
20. Hydraulic coupling
21. Control wires
22. Hydraulic line
23. Hydraulic connector
24. Three-Way hydraulic valve
25. Hydraulic pump outlet
26. Hydraulic connector
27. Quick disconnect hydraulic coupling
28. Electric hydraulic pump
29. Check valve
30. Three-way hydraulic connector
31. High efficiency filter
32. Lubricating fluid pressure sending unit
34. Engine lubricating gallery
36. Crankshaft relative motion metallic surfaces
38. Camshaft and valve train relative motion metallic surfaces
40. Internal pump
42. Engine oil pump discharge tube
44. Lubricating gallery
46. Battery
48. Standard wire means
50. Fuse
54. Electronic controller
56. Duration control means or knob
58. Frequency control means or knob
60. Local control switch
62. Standard wire means
64. Internal combustion engine
66. Remote operator
68. Control wire harness for remote operations
70. Engine oil filter mating surface
72. Assembly adapter
74. Oil filter

MODE OF OPERATION

The present invention method and apparatus is based on automatic operation made possible by the inclusion of a solid state timing control device, solid state controller, or adaptive controller operatively connected to a hydraulic electric pump. This control element switches electric control power from a normally provided battery and powers on an electric pump according to a programmed operating strategy stored in the control element. Inclusion of an electronic control element results in favorable design trade-offs and cooperating benefits in the form of simultaneous prelubricating, priming, and lubricant purifying. Additional benefits are found in the design, manufacture, simplicity, installation, safety, and convenience to the user. Furthermore, much smaller hardware size and power consumption are needed, since delivery time of the lubricating fluid is no longer of importance to the operator. This is possible because the present invention delivers the desired results automatically and without human intervention. Therefore, function delivery time is of no relevance, and waiting immediately before engine operation, as widely suggested in prior art, is eliminated.

The present invention takes advantage of the viscous properties of the lubricating oil, high viscosity gradient with respect to temperature, capillary forces, engine cool-down cycles, the small volume of oil that typical lubricating galleries require to fill-up, and the increasing time required for a viscous oil to flow from cooling surfaces typically separated by tight mechanical tolerances inside the conventional engine.

If a commercially available electric hydraulic pump delivers a lubricating oil to overfill the engine lubricating galleries. In addition, the engine has ceased operation and therefore is cooling down resulting in an increasing lubricating oil viscosity index over time. Further, the ability of the lubricating oil to flow is also decreasing as its temperature decreases. In addition, the period between automatic pump operations is smaller than the period of time required for the lubricating oil to drain from the desired wear intensive surfaces and passages. And lastly, a high arrestance filter is introduced in series with the hydraulic pump that processes incoming dirty lubricating oil into purified and substantially analytically clean oil. Therefore, the engine will automatically and simultaneously be substantially prelubricated to avoid wear during start-up, will reach normal oil operating pressure sooner upon start-up, will continuously have substantially cleaner oil due to automatic filtration, and it will be extremely convenient to use by eliminating operation immediately before start-up as suggested in the prior art.

Elimination of on-demand constraints found in prior art requiring operation immediately before and/or during start-up will lead to solving the unrecognized problem of inconvenience in prior art. It will also result in very favorable and previously unappreciated advantages in design trade-offs, and synergies in the cooperating functions of prelubricating, priming, purifying, and evacuating lubricating oil from the oil sump for the purpose of routine oil change.

DETAILED DESCRIPTION OF THE DRAWINGS

FIG. 1 shows a schematic of connection and description of my automatic method and preferred embodiment of my apparatus for preventing and reducing wear in an internal combustion engine 64. A lubricant, mineral or synthetic, lubricating oil 10 contained by a lubricating fluid sump, oil pan or oil sump 12, is allowed to flow through a hydraulic pump inlet 15. Pump inlet 15 is connected to a pressure raising device, fluid delivery device, or electric hydraulic pump 28. Hydraulic pump 28 has an outlet 25 connected through a hydraulic connector 23 to a hydraulic line 19 internal to engine 64 which is in turn connected to a one-way check valve or check valve 29 by a hydraulic connector 26. The check valve 29 is in turn connected to a high efficiency filter 31. Filter 31 filters to a substantially higher efficiency than the normally provided automotive engine filter and removes solid and dissolved contaminants according to filter 31 design parameters. Filter 31 is connected to a main engine lubricating gallery 34 and the injected oil passing to gallery 34 is substantially free from solid and chemical contaminants. This results in increasingly cleaner oil over time due to the present invention operating strategy.

Still referring to FIG. 1, intermittent operation of hydraulic pump 28 is controlled by a commercially available control means, solid state timing control device, adaptive controller, programmable digital logic controller, or electronic controller 54. Electronic controller 54, can have a very large number of setting combinations to perform automatic operation of hydraulic pump 28 in terms of very large number of combinations of duration of intermittent operation and operating frequency. In a simple embodiment, electronic controller 54 is equipped with a duration adjustment means, or duration control knob 56 and a frequency adjustment means, or frequency control switch or frequency control knob 58. Settings for duration control knob 56 and frequency control knob 58 are independent of each other, and capable of very large number of combination settings within a range continuum in the form of a control knob or a program routine. A local override control knob or local control switch 60 is also provided to override automatic operation and allow on demand operation of hydraulic pump device 28 locally. The integrated pump and controller, essentially a timed pump 17, is mounted or installed by well known means by securing it to oil sump 12 using an oil sump adapter and installation fixture 16 that lends mechanical stability and allows for the timed pump 17 to be safely submerged and having direct fluid connection to lubricating oil 10 inside oil sump 12.

The method of the present invention depends on control means or electronic controller 54 functions. Electronic controller 54 is also well known and is commercially available in standard or customized form from many manufacturers. Electronic controller 54 specified functions for achieving the automatic method of the present invention is common to the most preferred and other embodiments of this invention.

Still referring to FIG. 1, electronic controller 54 with duration control means or knob 56 which allows for controlling and adjusting pump 28 duration of operation, which is proportional to volume of lubricating oil 10 delivered into lubricating galleries 34. The electronic controller 54 with frequency control means or knob 58 which allows for controlling and adjusting pump 28 frequency or period of operation. Such frequency is dependent on various design parameters such as expected ambient temperature to adjust for viscosity gradients, size of the engine, etc. Such frequency of operation will be required to keep lubricating galleries 34 and metallic surfaces substantially lubricated. In addition, the frequency period is smaller than the time required for lubricating oil 10 to evacuate galleries 34, and due to gravity action drip from protected metallic surfaces.

Figure 2:
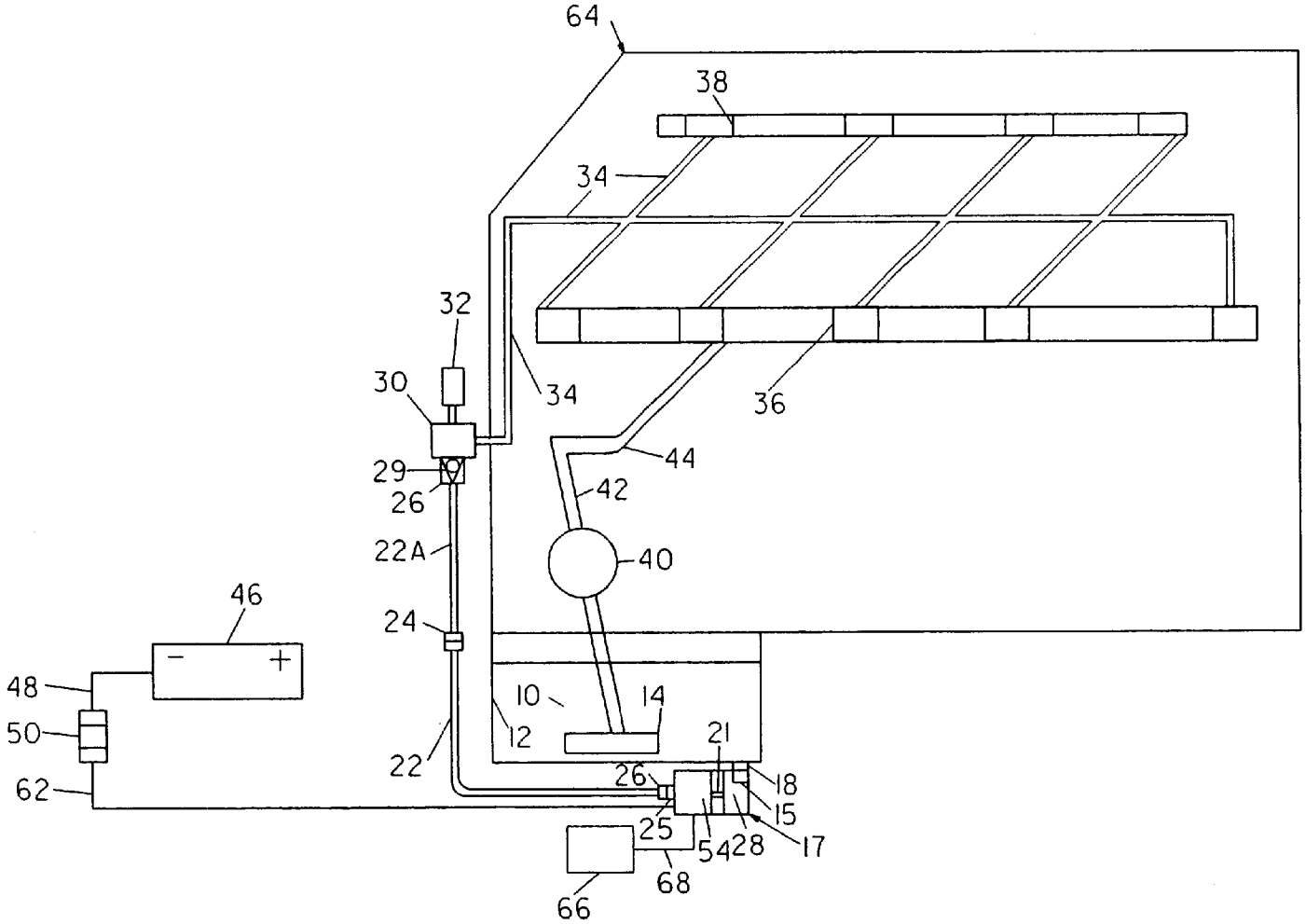
FIG. 2 is a side view illustrating diagrammatically the engine wear prevention system in an engine according to a second embodiment of the present invention with the programmable control element circuitry contained within the pump enclosure.

Electronic controller 54 has local control switch 60 which allows for local operation and overriding duration and frequency settings 56 and 58 for the purposes of evacuating all lubricating oil 10 from oil sump 12 after manually connecting to a three-way hydraulic valve 24, shown in FIG. 2, for the purpose of a typical oil change or testing pump 28 delivery volume.

Referring now to FIG. 1, electronic controller 54 allows remote operation by a remote operator 66 through a control wire harness for remote operation 68. Remote operator 66 can easily be a commercially available wireless remote control or a proximity sensor which can be operated or sensed automatically during walking approach to the automobile engine to be protected. Remote operator 66 can also be in combination with temperature sensors which may intervene in the operation of the device according to ambient temperature and program strategies. Electronic controller 54 allows for routing power for hydraulic pump 28 operation from an electric power source or battery 46. The electronic controller 54 is protected by a fusible link or fuse 50 to eliminate electrical overloaded conditions and limit short circuit damage. In addition, electronic controller 54 ceases all operation if a preset low voltage level is achieved for the purpose of avoiding total discharge of battery 46.

Electronic controller 54 is connected to fuse 50 by standard wire means 62 and fuse 50 is connected to battery 46 by standard wire means 48. Electronic controller 54 is electrically connected through fuse 50 to battery 46. Electronic controller 54 is electrically connected to hydraulic pump 28 through a suitable electric wire harness or control wires 21 contained inside the timed pump 17 and it is shown in FIG. 1 to illustrate its construction.

Engine lubricating galleries 34 are connected, as part of engine design to typical locations where frictional metallic surfaces exist, to a crankshaft and crankshaft and connecting rod bearings, or crankshaft relative motion metallic surfaces 36 and a camshaft, camshaft bearings and valve train, or camshaft and valve train relative motion metallic surfaces 38. By having very large number of combination settings for length and frequency of operation of hydraulic pump 28 by electronic controller 54, lubricating fluid 10 volumes can be delivered proportional to the duration of hydraulic pump 28 operation, and with a frequency of operation with a period shorter than the time that gravity requires for the lubricating fluid to evacuate lubricating galleries 34 and drip from relative motion metallic surfaces 36 and 38. Infinite or very large number of time and frequency combinations of hydraulic pump 28 operation will accommodate the great majority, if not all, of requirements depending on size of engine, viscosity of lubricating fluid, hydraulic pump volumetric capacity, ambient temperature, convenience, safety, engine cycle use, operator preferences, among others.

Once lubricating oil 10 is made to flow through engine lubricating galleries 34, the lubricating oil 10 is allowed to drip and flow back to oil sump 12 through natural gravity action after bathing, sticking to, and impregnating the lubricating oil 10 to relative motion metallic surfaces 36 and 38 to complete the automatic prelubricating cycle.

The operating cycle is defined as the combination of the elapsing time of a predetermined duration set by, and thereafter the elapsing of a predetermined period of time. The predetermined duration, during which the electric pump 28 is actuated by control means electronic controller 54, is within a range of 5 to 600 seconds and the predetermined period of time, during which the pump is off, is within a range of 2 to 720 minutes in order to accommodate most operating conditions. The elapsed time of the operating cycle is smaller than the time required for gravity to fully evacuate the lubricating oil from the lubricating galleries and internal moving metallic surfaces and it is performed whether engine 64 is running or not. In the case of an adaptive controller, this controller type learns and optimizes the operating cycle according to programmed parameters and engine 64 operating history. In addition, the system allows for quick and convenient evacuation of the engine oil for purposes of oil change.

Now referring to FIG. 2, this second embodiment departs from the most preferred embodiment by having the timed pump 17, connected immediately outside of oil pan 12. Hydraulic pump 28 inlet 15 is directly connected to oil pan 12 through a modified drain plug 18. Of course, the inlet 15 can be shaped to mate directly to oil sump 12 but it is shown with plug 18 for completeness. The timed pump 17 operates exactly in the same method as described for the preferred embodiment for frequency and duration of operation in FIG. 1. Timed pump 17 is also connected to remote operator 66 through control wire for remote operation 68, and timed pump 17 is also connected to the battery as shown in FIG. 1. Now referring back to FIG. 2, hydraulic pump outlet 25 is connected through hydraulic connector 26 to a hydraulic hose or hydraulic line 22, which in turn is connected to a multiposition valve, or three-way hydraulic valve 24. Still referring to FIG. 2, three-way hydraulic valve 24 allows for mutually exclusive hydraulic connection to hydraulic hose 22A or connection to the outside environment. Normal position of three-way hydraulic valve 24 is to fluidly connect hydraulic hose 22 to hydraulic hose 22A. Second position of hydraulic valve 24 is to fluidly connect hydraulic line 22 to the external environment. Hydraulic hose 22A is connected to check valve 29 through hydraulic connector 26. Check valve 29 is connected to a "tee" or a three-way hydraulic connector 30. Still referring to FIG. 2 connector 30 is connected to a lubricating fluid pressure sending unit 32 and permits simultaneous hydraulic connection of check valve 29, lubricating fluid pressure sending unit 32, and engine lubricating gallery 34. Lubricating gallery 34 is connected by manufacturer design to crankshaft and crankshaft and connecting rod bearings, or crankshaft relative motion metallic surfaces 36 and camshaft, camshaft bearings and valve train, or camshaft and valve train relative motion metallic surfaces 38. Of course, a three-way hydraulic connection can be achieved by the use of an assembly adapter 72 as shown in FIG. 5.

Figure 3:
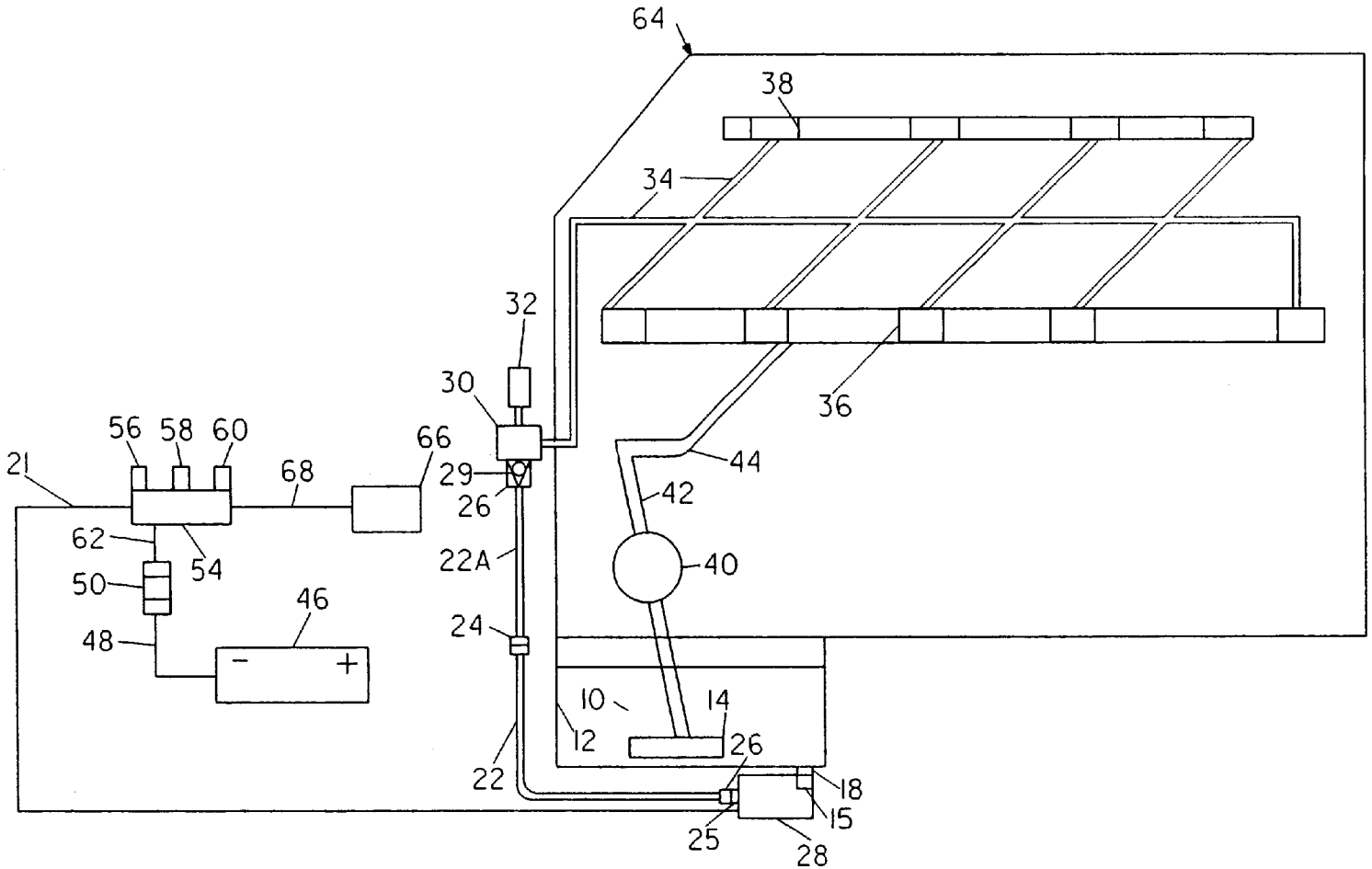
FIG. 3 is a side view illustrating the engine wear reduction system installed immediately next to the oil pan of a typical internal combustion engine, and equipped with a remotely located controller and connected to the oil gallery of a typical engine block through a "tee" hydraulic connector.

Now referring to FIG. 3, this third embodiment departs from the preferred in that it does not have and integrated pump and controller, but that the electronic controller 54 is remote from hydraulic pump 28. Electronic controller 54 is electrically connected to hydraulic pump 28 by means of electrical control wire harness 21. The method of operation is identical to the one disclosed in FIG. 1 and FIG. 2, but connection to engine block is the same as FIG. 2

Figure 4:
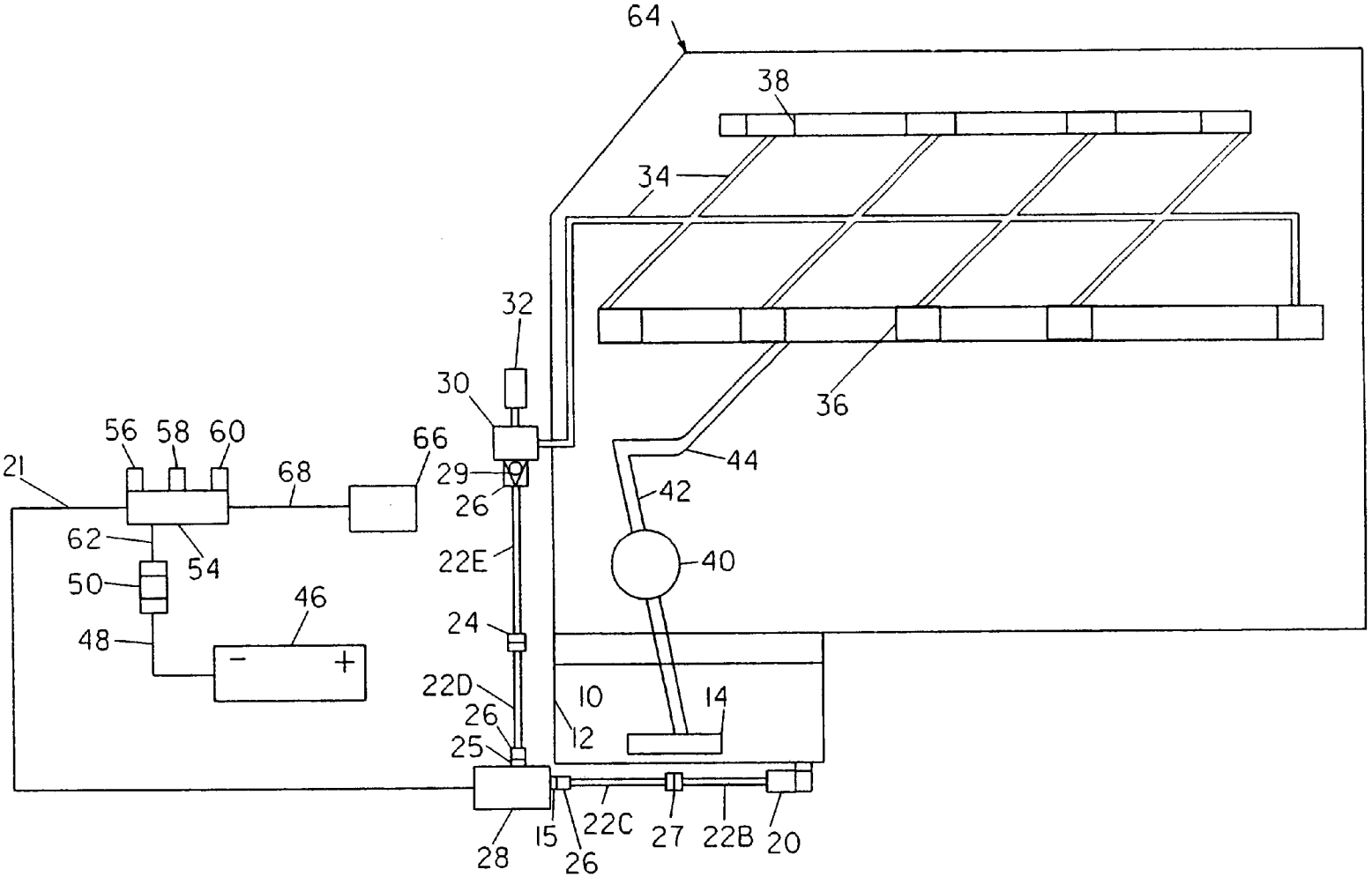
FIG. 4 is a side view diagrammatically illustrating the engine wear reduction system according to a fourth embodiment, showing my invention installed and externally connected to the oil gallery of a typical engine block through a "tee" hydraulic connector.

Now referring to FIG. 4, this fourth embodiment shows another schematic of connection and description of another embodiment of my automatic method and apparatus for reducing wear in an internal combustion engine. Lubricating oil 10 contained in oil sump 12, is allowed to flow through a hydraulic coupling 20 to allow evacuation of lubricating oil 10 from oil sump 12 and flow through a hydraulic fluid line or hose 22B. Hydraulic fluid line 22B is connected to a quick disconnect hydraulic coupling 27, which is connected to hydraulic line 22C. Part 22C is connected to hydraulic connector 26 and this is connected to pump inlet 15 of hydraulic pump 28. Hydraulic pump 28 outlet 25 is connected to hydraulic line 22D by hydraulic connector 26. Hydraulic line 22D is connected to a three-way hydraulic valve 24. From valve 24, embodiment of FIG.4 is identical in the description of connection to the engine block as the one disclosed in FIG. 2 embodiment and can also use the connection method of FIG. 5A and an assembly adapter 72 illustrated in FIG. 5B. The operation of electronic controller 54 and method is identical to the embodiments of FIG. 1,2, and 3.

Figure 5A:
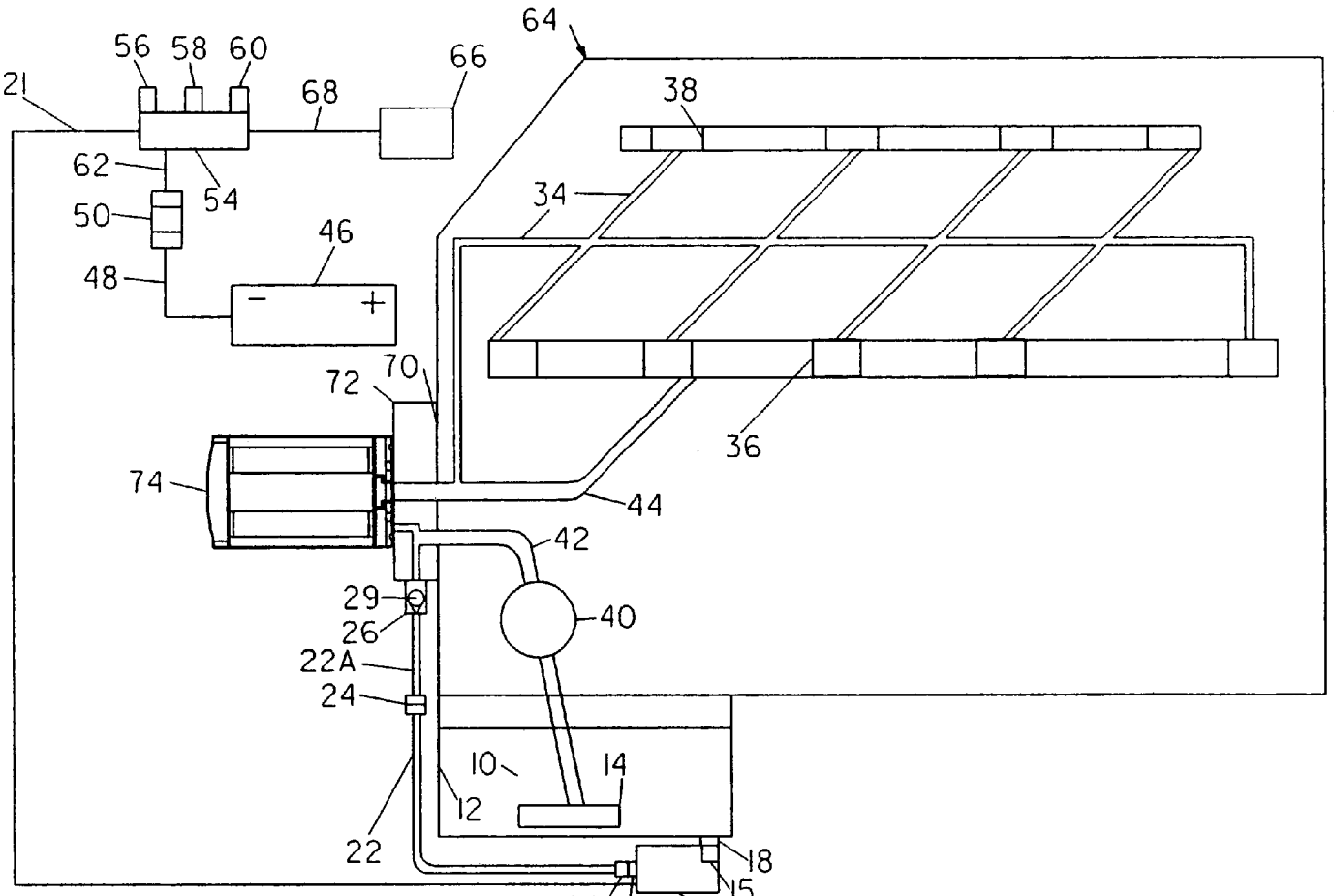
FIG. 5A is an schematic view of a typical internal combustion engine, showing my invention installed into and externally connected to the engine by means of an oil filter adapter to allow discharge of the lubricating fluid or oil inside the oil filter lubricating circuit.
Figure 5B:
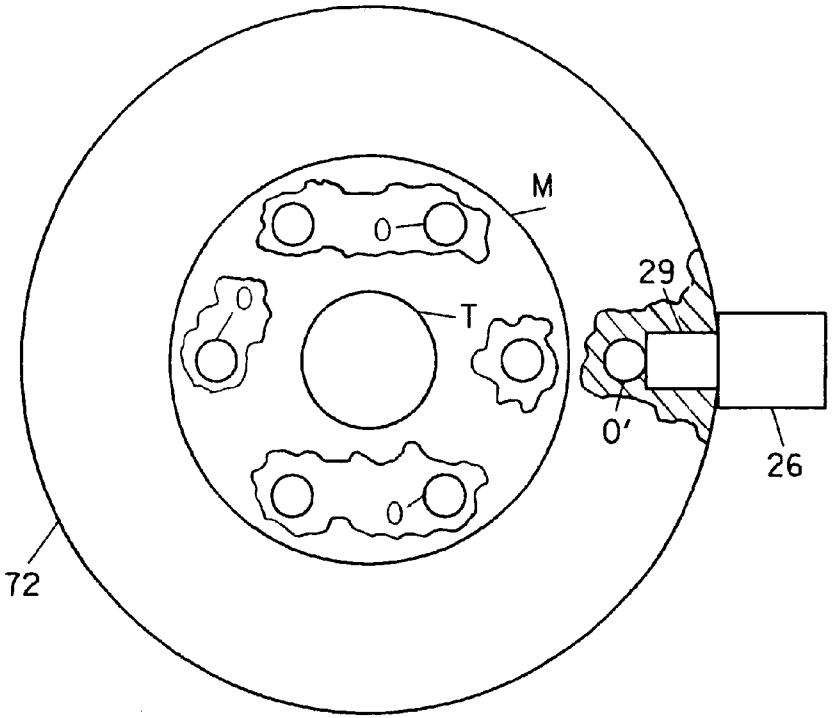
FIG. 5B is a side and top view of assembly adapter that facilitates installation of the embodiment shown in FIG. 5A and keeps engine lubricating galleries and system substantially primed.
Figure 5B:
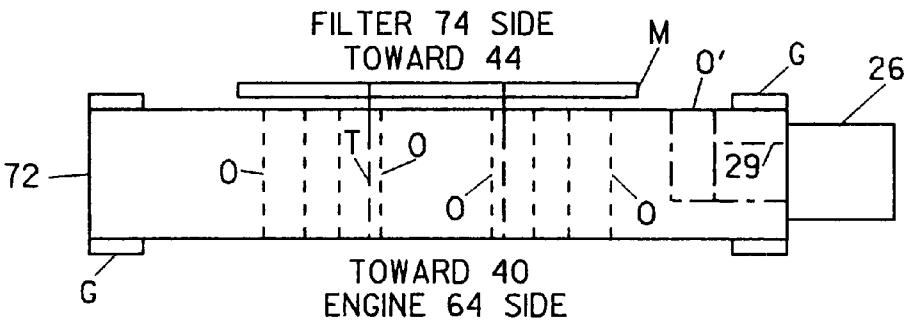
Figure 5C:
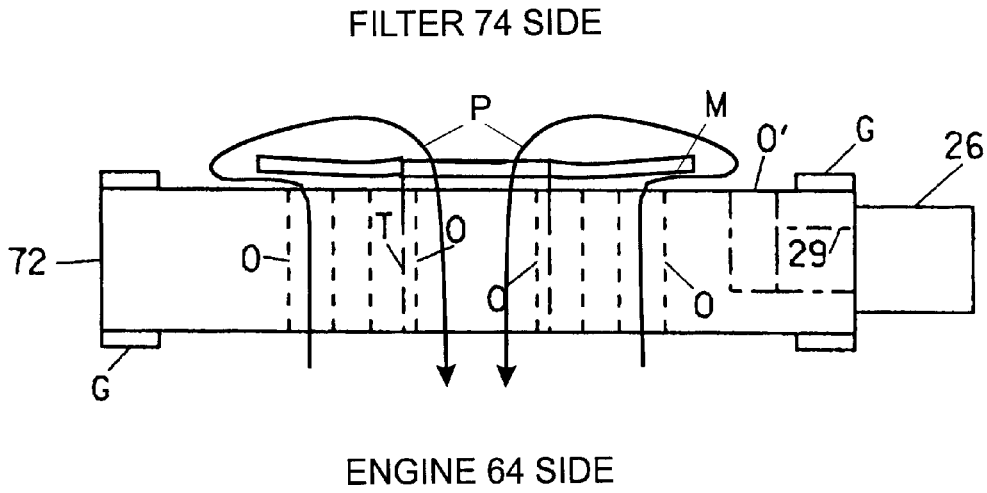
FIG. 5C is a side view of the assembly adapter of FIG. 5B illustrating operation of membrane M to allow normal oil flow.
Figure 5D:
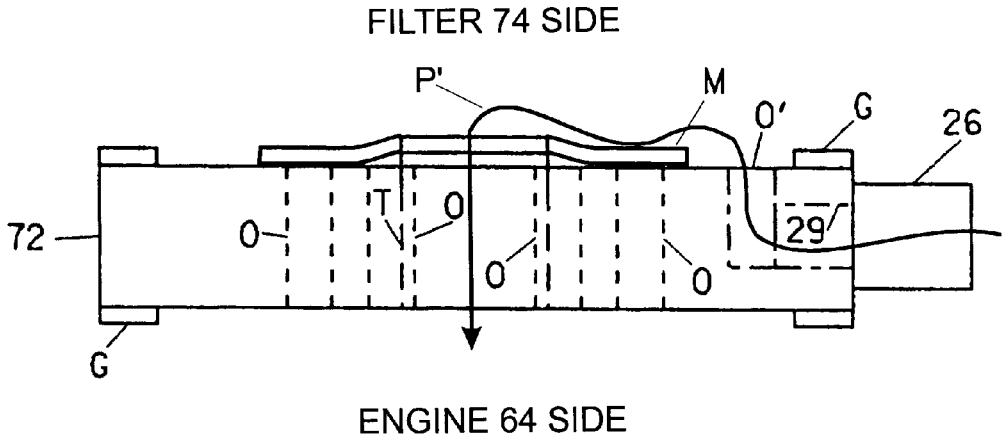
FIG. 5D is a side view of the assembly adapter of FIG. 5B illustrating operation of membrane M to prevent backflow.

Now referring to FIG. 5A, this fifth embodiment is identical in method, and theory of operation and in components to embodiment disclosed in FIG. 3. This embodiment of FIG. 5A departs from FIG. 3 only in the inclusion, after check valve 29 in FIG. 3, of assembly adapter 72, which allows for the connection of the system to the inlet circuit of a standard oil filter 74, and the eventual release of lubricating oil 10 through assembly adapter 72 and into a main oil gallery 44. Assembly adapter 72 is more easily appreciated in FIG. 5B which illustrates assembly adapter 72 with a central thread T that matches the normally provided threaded point of connection for a normal oil filter of engine 64. A plurality of orifices O, is disposed around the periphery of central thread T to allow flow of oil during normal engine operation. The present invention injects oil through an orifice O', a membrane M biased against the orifices prevents backflow of that injected oil, essentially making adapter 72 to behave as a check valve. Of course, gap illustrated between membrane M and adapter 72 in FIG. 5B is exaggerated for illustration only. Referring to FIG. 5A and FIG. 5C, this is done by allowing flow from internal pump 40, through a normally provided engine oil pump discharge tube 42, through adapter 72 (along path P shown in FIG. 5C) and into a main oil gallery 44 but preventing oil flow in the opposite direction when oil is injected along path P' as shown in FIG. 5D. Now referring to FIG. 5B, assembly adapter 72 is used to facilitate the present invention installation and for the purpose of keeping a main lubricating gallery 44 and galleries 34 sufficiently primed at all times due to the periodic injection of lubricating oil 10 by the present invention. Since periodically injected lubricating oil 10 is prevented to flow through the mechanical tolerances of internal pump 40 by adapter 72, the only way to escape and flow back to oil sump 12 is inevitably through the mechanical tolerances that the system intends to protect from wear. Referring to FIG. 5B, this is possible since the injected charge of oil 10 flows through check valve 29 and orifice O' which only connects hydraulically to main oil gallery 44 and not to pump 40 in FIG. 5A. Referring to FIG. 5B, assembly adapter 72, said adapter main body shaped as a thin hockey puck, allows for easy installation of the device and for easy hydraulic access to the lubricating gallery circuits by connecting the present invention through hydraulic connector 26 which in turn is connected to chech valve 29 which prevents lubricating oil 10 backflow during normal engine 64 operation. In fact, anybody with a rudimentary knowledge of an oil change is benefited with this present invention. Furthermore, since oil injection time is ignored, the low flow requirements of the present invention operating strategy allow for the design of the adapter 72 to be very thin within a range of 0.20 to 1.50 inches, because pressure drop caused by flow is irrelevant. This is a favorable design trade-off and it is possible due to my operating strategy. Bulky prior art adapters lack that since prior art must deliver much higher flows with respect to time and therefore require much larger and complicated adapter hardware and larger flow paths. This favorable design trade-off results in adapter 72 which is simply sandwiched between filter 74 and a normally provided engine oil filter mating surface 70 using a set of standard gaskets G as shown in FIG. 5B, and taking advantage of the normal design of the normally provided oil filter threaded point of connection in automobile engines.

It will be understood that each of the elements described above, or two or more together may also find a useful application in other types of methods differing from the type described above.

While certain novel features of this invention have been shown and described and will be pointed out in future claims, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A method for reducing wear in an internal combustion engine having a battery, an engine lubricating gallery, an oil, said method comprising the steps of:

a. providing an adaptive control means coupled to a pump for switching power from said battery to said pump;

b. programming said adaptive control means with an adaptive operating cycle comprising a first period of time and a second period of time;

c. periodically actuating said pump during said first period of time to inject said oil into said engine lubricating gallery and deactivating said pump during said second period of time; and d. periodically adaptively adjusting said operating cycle according to predetermined optimization criteria;

whereby said engine is automatically prelubricated and protected from wear.

2. The method of claim 1 wherein first period of time has a duration within a range of 5 to 600 seconds and said second period of time as a duration within a range of 2 to 720 minutes.

3. The method of claim 1 wherein step c is carried out independently of said internal combustion engine operating state.

4. The method of claim 1 wherein said adaptive control means adjusts said adaptive operating cycle according to a set of programmed parameters and an engine operating history.

5. An apparatus for reducing wear in an internal combustion engine, said apparatus disposed inside said engine, said engine having a battery, an engine lubricating gallery, an oil, said apparatus comprising:

a pump;

an inlet of said pump immersed in said oil;

an outlet of said pump fluidly connected to said engine lubricating gallery; and programmable control means coupled to said battery for operating said pump automatically;

whereby said apparatus prelubricates said engine automatically.

6. The apparatus of claim 5 further comprising a check valve in said outlet of said pump.

7. The apparatus of claim 5 and further comprising a high efficiency filter connected to said outlet of said pump for substantially removing contaminants from said oil.

8. The apparatus of claim 5 and further comprising a remote operator operatively connected to said control means for enabling said pump remotely.

9. The apparatus of claim 5 and further comprising a fuse interconnected with said battery for preventing electric overload.

10. The apparatus of claim 5 and further including in said control means voltage sensing logic means for ceasing automatic operation of said apparatus if a preset low voltage is detected for avoiding said battery being discharged.

11. An apparatus for reducing wear in an internal combustion engine, said engine having a battery, an engine lubricating gallery, a lubricating fluid pressure sending unit, a threaded point of connection for an oil filter, an oil sump, an oil, said apparatus comprising:

a pump;

an inlet of said pump affixed and fluidly connected to said oil sump;

first conduit means connecting an outlet of said pump to said engine lubricating gallery; and adaptive control means coupled to said battery for operating said pump;

whereby said apparatus prelubricates said engine automatically.

12. The apparatus of claim 11 and further comprising a modified drain plug having a center channel to fluidly connect said inlet of said pump to said oil contained in said oil sump.

13. The apparatus of claim 11 and further comprising a check valve in said first conduit means.

14. The apparatus of claim 11 and further comprising a second conduit means for fluidly connecting said modified drain plug to said inlet side of said pump.

15. The apparatus of claim 11 and further including a three way hydraulic valve interposed in said first conduit means.

16. The apparatus of claim 11 and further comprising a remote operator operatively connected to said control means for enabling said pump remotely.

17. The apparatus of claim 11 and further including in said control means voltage sensing logic means for ceasing automatic operation of said apparatus if a preset low voltage is detected for avoiding said battery being discharged.

18. The apparatus of claim 11 and further including a three way hydraulic connector for fluidly connecting said apparatus, said lubricating fluid pressure sending unit, and said engine lubricating gallery.

19. The apparatus of claim 11 and further including an assembly adapter interposed between an engine oil filter mating surface of an internal combustion engine and an oil filter, said engine having a threaded point of connection for said filter, an oil, an internal pump, a main oil gallery, said adapter comprising:

a main body shaped as a thin cylinder having a centrally located threaded channel matching said threaded point of connection;

a plurality of orifices disposed around said threaded channel to allow flow of said oil through said main body;

a flexible membrane biased against and covering said plurality of orifices to prevent unwanted flow in the direction of said internal pump and to allow flow in the direction of said main oil gallery;

a means to seal said adapter when interposed between said normally provided engine oil filter mating surface of said internal combustion engine and said oil filter;

an orifice having fluid communication in the direction of said oil main gallery and the atmosphere;

a check valve fluidly interposed between said orifice and the atmosphere;

whereby access to said main oil gallery is substantially facilitated and oil is prevented to back flow.

20. The apparatus of claim 19 wherein the thickness of said main body is within a range of 0.20 to 1.50 inches.

* * * * *